US008998044B1

(12) United States Patent
Perrin

(10) Patent No.: US 8,998,044 B1
(45) Date of Patent: Apr. 7, 2015

(54) GARMENT SEPARATOR ASSEMBLY AND METHOD OF USE

(71) Applicant: Stacy Elizabeth Perrin, Boynton Beach, FL (US)

(72) Inventor: Stacy Elizabeth Perrin, Boynton Beach, FL (US)

(73) Assignee: SAC Concepts, LLC, Boca Raton, FL (US)

( * ) Notice: Subject to any disclaimer, the term of this patent is extended or adjusted under 35 U.S.C. 154(b) by 0 days.

(21) Appl. No.: 14/455,507

(22) Filed: Aug. 8, 2014

(51) Int. Cl.
*A47G 25/48* (2006.01)
*A47G 25/14* (2006.01)
*A41D 27/22* (2006.01)

(52) U.S. Cl.
CPC ..... *A47G 25/1471* (2013.01); *A47G 25/1442* (2013.01); *A47G 25/14* (2013.01)

(58) Field of Classification Search
USPC ..... 223/85, 88, 91; 211/113, 118, 119, 211/119.12, 123, 124; 248/317; D6/328, D6/513
See application file for complete search history.

(56) References Cited

U.S. PATENT DOCUMENTS

| | | | | |
|---|---|---|---|---|
| 1,745,942 | A | 2/1930 | Miley | |
| 2,868,389 | A | 8/1955 | Friend | |
| 2,895,618 | A | 7/1959 | Nathan | |
| 3,085,691 | A * | 4/1963 | Smith | 211/119.12 |
| 3,085,724 | A | 4/1963 | Wilde | |
| 3,184,204 | A * | 5/1965 | Dachinger | 248/323 |
| 3,240,462 | A * | 3/1966 | Schneider | 248/323 |
| 3,482,746 | A * | 12/1969 | Ferguson | 223/85 |
| 4,553,294 | A * | 11/1985 | Larsen | 24/489 |
| 4,577,766 | A | 3/1986 | Miller | |
| 4,760,929 | A | 8/1988 | Fedorchak | |
| 4,944,417 | A | 7/1990 | Datlow | |
| 4,971,210 | A * | 11/1990 | Blumenkranz et al. | 211/123 |
| 5,076,447 | A * | 12/1991 | De Beer | 211/123 |
| 5,336,179 | A * | 8/1994 | Ryan | 604/80 |
| 5,836,486 | A * | 11/1998 | Ohsugi | 223/85 |
| 6,434,803 | B1 * | 8/2002 | Spong | 24/543 |
| 2006/0278594 | A1 | 12/2006 | Macon | |

* cited by examiner

*Primary Examiner* — Ismael Izaguirre
(74) *Attorney, Agent, or Firm* — The Concept Law Group, P.A.; Scott D. Smiley; Erin A. Martin

(57) ABSTRACT

A garment separator assembly is disclosed that includes at least two separators for maintaining even spacing between a plurality of clothing hangers on a clothing rod. The separators are spaced a distance apart that allows only a single clothing hanger to fit therebetween. Each separator includes a first member defining a first half of the separator and a second member hingedly coupled to the first member and defining an opposing second half of the separator. The second member, together with the first member, define a first inner-surface circumference and a second inner-surface circumference, wherein the second inner-surface circumference is adjacent the first inner-surface circumference. The first inner-surface circumference is larger than the second inner-surface circumference and both are sized and shaped to mate with clothing rods of various sizes and shapes.

17 Claims, 8 Drawing Sheets

100

100

106

GARMENT SEPARATOR ASSEMBLY AND METHOD OF USE

FIELD OF THE INVENTION

The present invention relates generally to an assembly for separating garments, and, more particularly, relates to a garment separator assembly for maintaining even spacing between garments.

BACKGROUND OF THE INVENTION

Many types of garments, i.e., clothing, are commonly stored on clothing hangers. Although there are numerous types of clothing hangers and clothing rods, which together allow users to store garments in home closets or on racks in a retail environment, little attention has been paid to effective solutions to keep garments separated from each other. In particular, little effort has been spent developing a way to easily maintain consistent spacing between garments. Such uniformity is not only aesthetically pleasing, it also allows garments to be easily organized and identified. Further, properly spaced garments are less likely to wrinkle, harbor odors from inadequate ventilation, or become damaged by an adjacent garment's buttons, zippers, or other protrusions.

A number of known devices which attempt to provide spacing between garments are, for various reasons, inadequate, inefficient, or cumbersome. For example, some known garment separators are difficult to attach and detach from a clothing rod. These devices feature members that lock together, but require special tools or great force to remove. For example, U.S. Pat. No. 4,971,210 describes clothing spacers that require "snap enclosures" to secure two "hemi-shells" closed. Once closed, the snap enclosures are hidden inside the hemi-shells and access to them is restricted. Other existing garment separators are not adaptable to different sizes, i.e., outer diameters, and shapes, e.g., square, round, ovular, etc., of clothing rods. Yet other garment separators slide easily on the clothing rod, but are thus too easily displaced from their desired position, allowing garments to bunch together. Other known devices which provide spacing between garments utilize a sleeve that slips over the top of a clothing rod to provide indentations for multiple hangers. Examples of this kind of closet organizer can be found in U.S. Pat. Nos. 4,971,210, 2,895,618, 2,868,389, 4,760,929, and 4,577,766, and U.S. Patent Pub. 2006/0278594. One of the problems with utilizing a sleeve is that the sleeve is semi-permanent and in order to move or remove the sleeve or create areas along the bar that are free from the organizer, a user must first remove multiple garments that are hanging from the sleeve, which is a burdensome and time-consuming task. With some sleeve devices, the entire closet bar must be removed from the closet in order to extract the sleeve organizer.

U.S. Pat. No. 1,745,942 describes a garment separator for use in retail environments. The separator is designed to hold a sign that indicates the size of the garments adjacent the sign. The separator shown in U.S. Pat. No. 1,745,942 is a clamp that closes to a fixed minimum clothing bar size. It cannot be attached to, for example, the small diameter wire racks used in many newer houses and apartments. In addition, the sign attached to the clamping end makes it difficult to operate the clamp. The protruding sign further creates and aesthetically unpleasant clamp unacceptable for home use.

Therefore, a need exists to overcome the problems with the prior art as discussed above.

SUMMARY OF THE INVENTION

The invention provides a garment separator that overcomes the hereinafore-mentioned disadvantages of the heretofore-known devices and methods of this general type and that provides consistent spacing between garments hanging from clothing hangers.

With the foregoing and other objects in view, there is provided, in accordance with the invention, a garment separator assembly that includes at least two separators. Each separator includes a first member defining a first half of the separator and a second member defining an opposing second half of the separator. The second member is hingedly coupled to the first member and, together with the first member, defines a first inner-surface circumference and a second inner-surface circumference adjacent the first inner-surface circumference. The first inner-surface circumference is larger than the second inner-surface circumference.

In accordance with a further feature of the present invention, the garment separator assembly includes a spring loaded hinge attaching the first member to the second member.

In accordance with an additional feature of the present invention, the garment separator assembly includes a first ear mechanically coupled to the first member and a second ear mechanically coupled to the second member, wherein movement of the first ear relative to the second ear results in a corresponding movement of the first member relative to the second member.

In accordance with yet another feature of the present invention, the first inner-surface circumference is shaped and sized to mate with an outer diameter of a standard clothing rod.

In accordance with yet another feature of the present invention, the garment separator assembly includes a frictional coating on at least one of the first inner-surface circumference and the second inner-surface circumference.

In accordance with a further feature, the garment separator assembly includes a clothing rod and a plurality of clothing hangers coupled to the clothing rod and each separated by a separator.

In accordance with another feature of the present invention, the separators are spaced a distance apart that allows only a single clothing hanger to fit there between.

In accordance with another feature of the present invention, in one embodiment, the garment separator assembly is designed as an improvement to the standard clothing closet and is provided in combination with a clothing closet having a horizontal clothing rod and a plurality of clothing hangers hanging from the horizontal clothing rod. The garment separator assembly includes a first separator on a first side of one of the plurality of clothing hangers and a second separator on an opposing second side of the one of the plurality of clothing hangers. The first separator and the second separator are distanced to only allow the one of the plurality of clothing hangers to fit there between. Each separator includes a first member defining a first half of the separator and a second member defining an opposing second half of the separator. The second member is hingedly coupled to the first member and, together with the first member, defines a first inner-surface circumference and a second inner-surface circumference adjacent the first inner-surface circumference. The first inner-surface circumference is larger than the second inner-surface circumference.

In accordance with another feature of the present invention, the outer diameter of the standard clothing rod is at least one of a circular and rectangular shape.

In accordance with a further feature of the present invention, the first member and the second member substantially surround the outer diameter of the standard clothing rod.

In accordance with yet another feature of the present invention, the second-inner surface circumference is shaped and sized to mate with an outer diameter of a clothing rod, wherein the outer diameter is smaller than an outer diameter of a standard clothing rod.

In accordance with another feature of the present invention, the first ear is mechanically coupled to the first member at a pivot point and the second ear is mechanically coupled to the second member at the pivot point, wherein movement of the first ear relative to the second ear results in a corresponding movement of the first member relative to the second member.

In accordance with another feature of the present invention, the first separator and the second separator are selectively detachable from the horizontal clothing rod.

In accordance with the present invention, a method of separating garments includes providing a horizontal clothing rod and a plurality of clothing hangers hanging from the horizontal clothing rod; and providing at least two separators. Each separator includes a first member defining a first half of the separator and a second member defining an opposing second half of the separator. The second member is hingedly coupled to the first member and, together with the first member, defines a first inner-surface circumference and a second inner-surface circumference adjacent the first inner-surface circumference. The first inner-surface circumference is larger than the second inner-surface circumference. The first inner-surface circumference is shaped and sized to mate with an outer diameter of a standard clothing rod and the second inner-surface circumference shaped and sized to mate with a smaller outer diameter of a narrower sized clothing rod. The method further includes removably coupling at least one of the at least two separators to a first side of one of the plurality of clothing hangers; and removably coupling a second one of the at least two separators to an opposing second side of the one of the plurality of clothing hangers. The at least two separators are distanced to only allow the one of the plurality of clothing hangers to fit there between. The first member is attached to the second member by a spring loaded hinge. A frictional coating is included on at least one of the first inner-surface circumference and the second inner-surface circumference. A first ear is mechanically coupled to the first member and a second ear is mechanically coupled to the second member, wherein movement of the first ear relative to the second ear results in a corresponding movement of the first member relative to the second member.

Although the invention is illustrated and described herein as embodied in a garment separator it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

Figure 1:
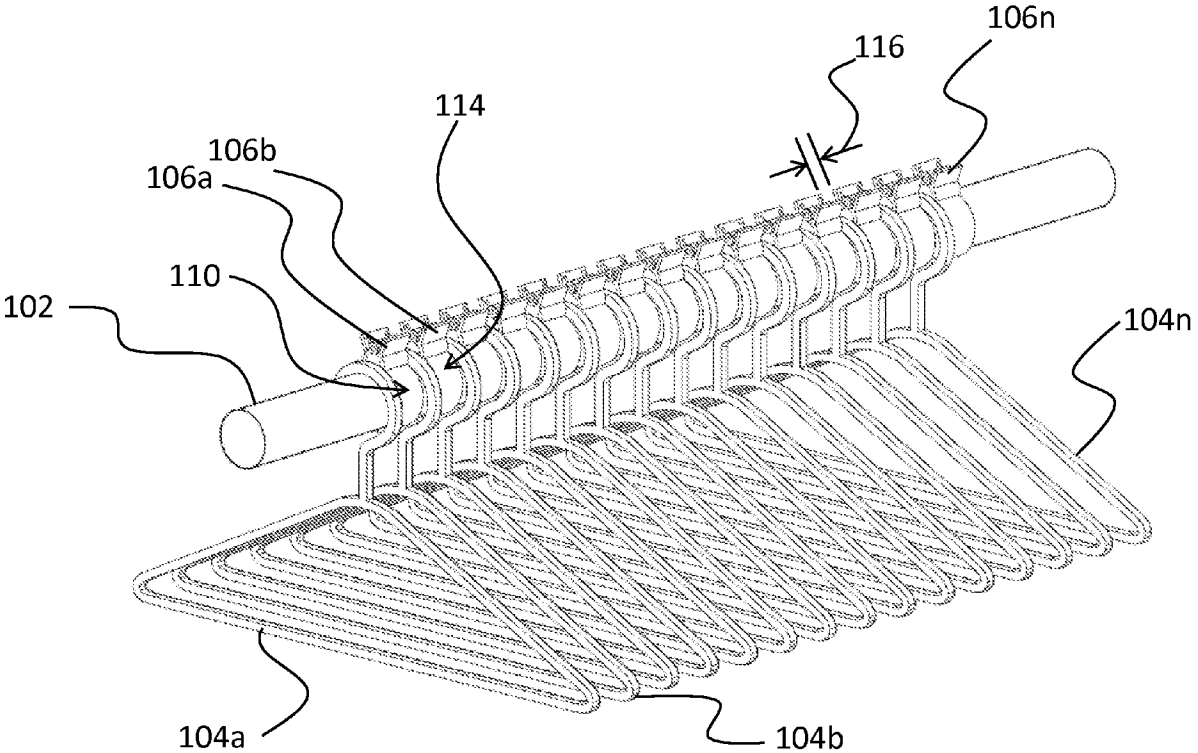
FIG. 1 is a perspective view of a garment separator assembly depicting a plurality of separators attached to a closet bar, each positioned on either side of clothing hangers in accordance with the present invention.
Figure 12:
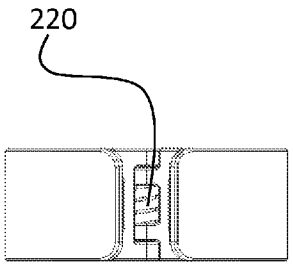
Figure 7:
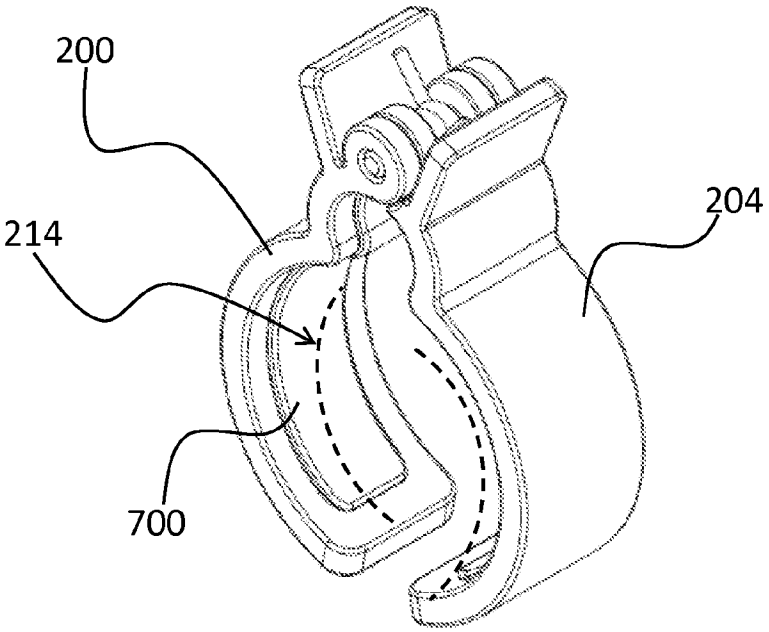
Figure 8:
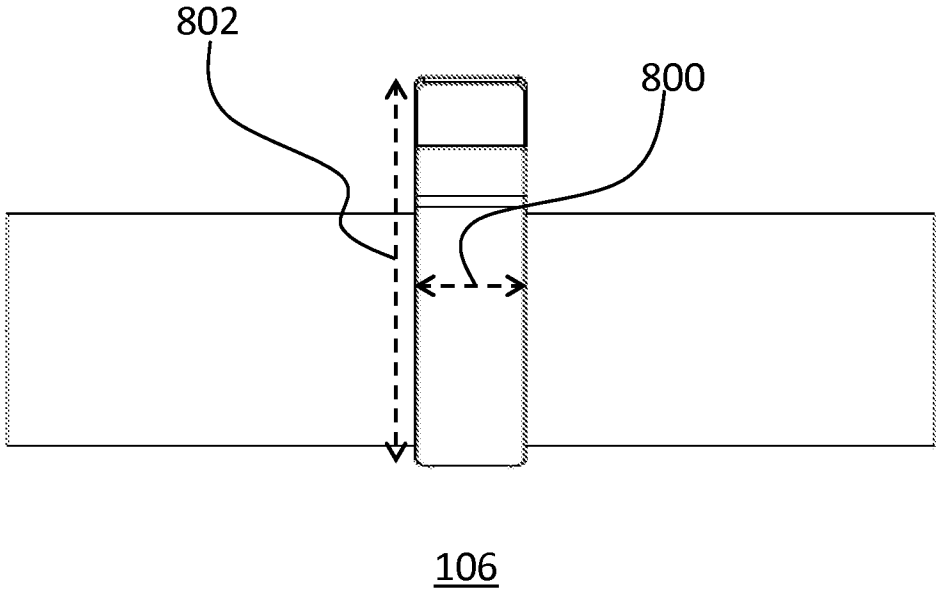
Figure 9:
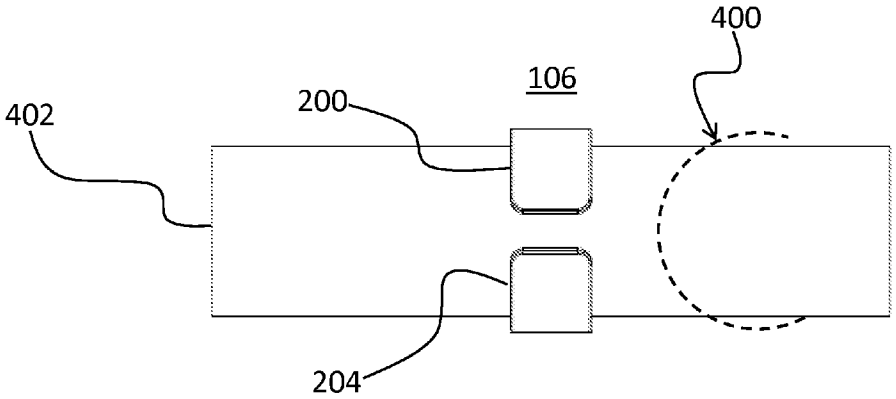
Figure 10:
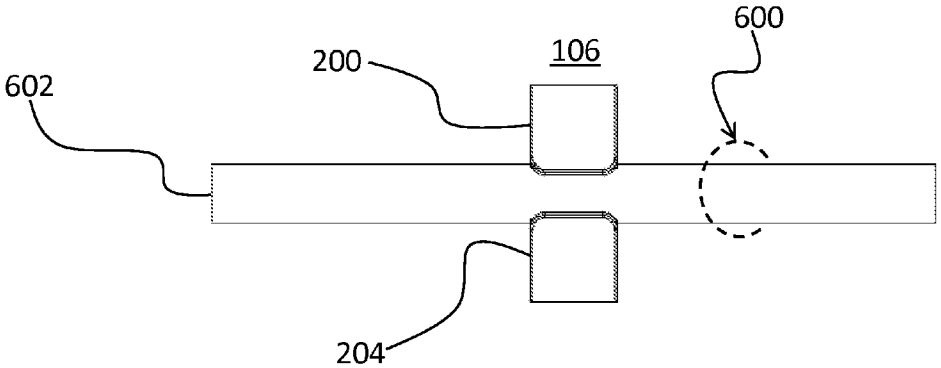
Figure 11:
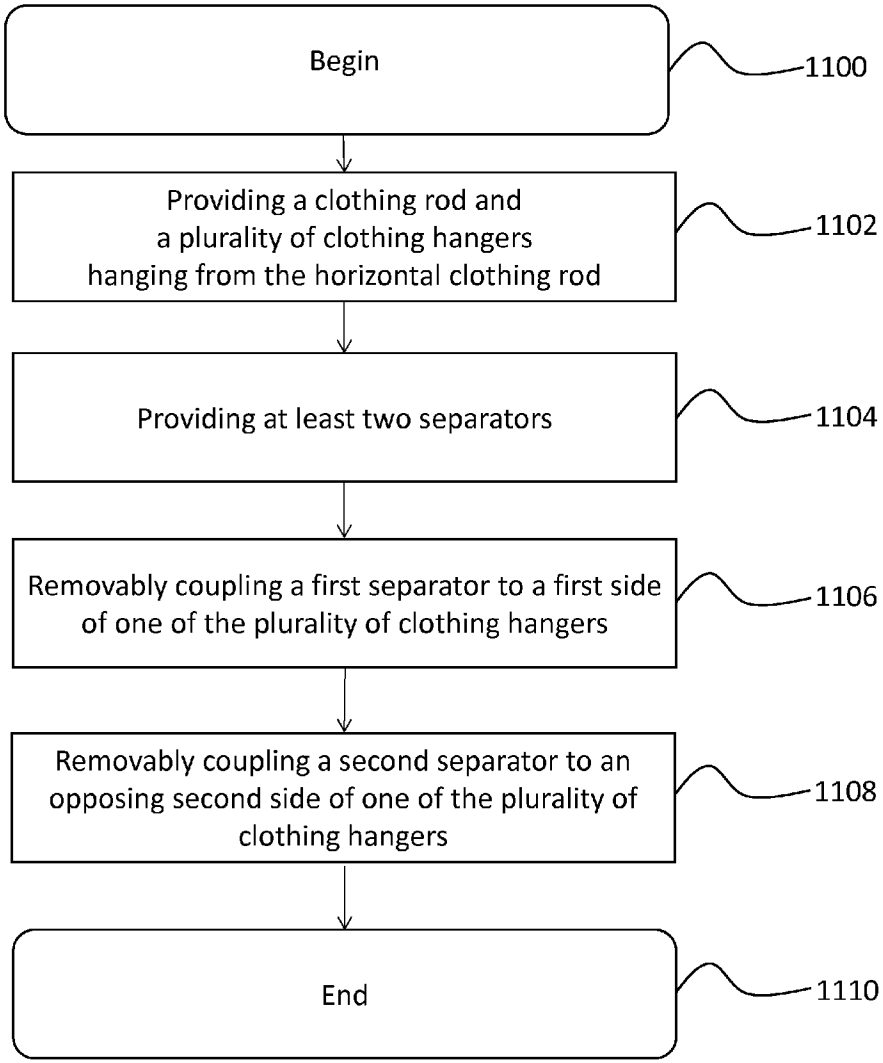

FIG. 7 is a perspective view of one of the plurality of separators of FIG. 1 depicting a frictional coating covering an inner-surface portion of the separator in accordance with an embodiment of the present invention;

FIG. 8 is a elevational side view of one of the plurality of separators of FIG. 1 coupled to the standard clothing rod of FIG. 1;

FIG. 9 is an elevational bottom view of one of the plurality of separators of FIG. 1 depicting the inner surface substantially surrounding the standard clothing rod of FIG. 1;

FIG. 10 is an elevational bottom view of the separators of FIG. 1 depicting the inner surface substantially surrounding a smaller-diameter clothing rod in accordance with an embodiment of the present invention;

FIG. 11 is a flow diagram for illustrating a process of separating garments using the garment separator assembly of FIG. 1; and FIG. 12 is an upward-looking elevational view of the inner surface of the separator of FIG. 1 showing a spiral hinge attaching a first separator member to a second separator member in accordance with an embodiment of the present invention.

DETAILED DESCRIPTION

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient garment separator assembly and method designed to maintain even spacing between individual hangers hanging from a clothing rod. Embodiments of the invention provide the user with the ability to utilize the garment separator assembly with a variety of clothing rods having different diameters. In addition, embodiments of the invention provide a plurality of separators that can quickly and easily be attached and detached from the clothing rod.

Referring now to FIG. 1, one embodiment of the present invention is shown in a perspective downward-looking view. FIG. 1 shows several advantageous features of the present invention, but, as will be described below, the invention can be provided in several shapes, sizes, combinations of features and components, and varying numbers and functions of the components. The first example of a garment separator assembly 100 is intended to be used in combination with and can include a clothing closet (not shown) having a clothing rod 102 and a plurality of clothing hangers 104 hanging from the clothing rod 102. The term "clothing rod" is defined herein as a rod that is operable for holding clothing hangers. Any reference herein to a "clothing rod" shall be considered as a reference to a "horizontal clothing rod." In another embodiment, the garment separator assembly 100 may be used in combination with a clothing rack, such as a clothing rack located at a retail store. In yet another embodiment, the garment separator assembly 100 may be used with a clothing rod 102 attached to a freestanding clothing rack.

The garment separator assembly 100 includes an array of separators 106*a-n*, each providing space to fit a single clothing hanger 104 therebetween. The indicator "a-n" is intended to represent any number of items, with "a" indicating 1 and "n" indicating any number greater than 1. Therefore, the inventive garment separator assembly 100 includes at least 2 garment separators 106. In use, the number of separators 106*a-n* will vary according to the length of the clothing rod 102 and the number of clothing hangers 104 hanging from the clothing rod 102. The garment separator assembly 100 is designed as an improvement to the standard clothing closet because the garment separator assembly 100 maintains even spacing between clothing hangers 104 hanging from the clothing rod 102. Advantageously, the even spacing allows garments to be organized in such a manner so that the garments can be easily identified. As an added advantage, the evenly spaced garments are exposed to ample ventilation, and are less likely to become wrinkled or damaged by an adjacent garment's zippers, sequins, beads, decorations, or other protruding members. The term "garment" is defined herein as an article of clothing which includes, but is not limited to, dresses, suits, pants, tops, and skirts. Any reference herein to "clothing" shall be considered as a reference to "garments."

The material of the separator 106 is preferably a lightweight material such as plastic, e.g., polyethylene terephthalate (PET or PETE), high-density polyethylene (HDPE), polyvinyl chloride (PVC), low-density polyethylene (LDPE), polypropylene (PP), polystyrene (PS), and the like. The material can also be wood, rubber, or any other material, which, preferably, does not add substantial weight to the clothing rod 102. In a preferred embodiment, the weight of the separator 106 is equal to or less than a standard clothing hanger. The lightweight material reduces the risk of the clothing rod 102 falling due to the weight of the separators 106*a-n* and garments hanging from the clothing hangers 104. In a preferred embodiment, the material has a smooth outer surface so as not to cause snags, rips, or tears when coming into contact with garments. The separators 106*a-n* may be manufactured in a variety of patterns, e.g., animal print, floral, polka dots, stripes, etc. Alternatively, the separators 106*a-n* may be manufactured in a variety of colors, e.g., white, clear, chrome, or another color or finish, so that a user can choose an aesthetically pleasing pattern or color. Advantageously, the user is given the option of matching the pattern or color of the separators 106*a-n* to the pattern or color of the clothing hangers 104, for a coordinated visual appearance. The separator assembly 100 can be provided in a kit, which includes the plurality of separators 106*a-n* divided into groups, each group being one of a variety of colors, e.g., red, blue, white, tan, etc. In this embodiment, the user is given the option of matching the color of the separator 106 to the color of the clothing hung between the separators 106*a-n*. In this embodiment, the user is also given the option of matching the color of the separator 106 to the color of the clothing hanger hung between the separators 106*a-n*. This embodiment makes organizing a closet by color very simple and causes the separators to blend in and not be noticeable.

In order to effectively maintain even spacing between the clothing hangers 104, in a preferred embodiment, the garment separator assembly 100 includes the separators 106*a-n* spaced a distance 116 that only allows a single clothing hanger 104 to fit between each individual separator 106. A preferred embodiment is shown in FIG. 1, having a first separator 106*a* on a first side 110 of the clothing hanger 104, and a second separator 106*b* on an opposing second side 114 of the clothing hanger 104. Advantageously, the garment separator assembly 100 maintains even spacing between the clothing hangers 104. In another embodiment, the separators 106*a*, 106*b* may allow a pair of clothing hangers 104 to fit between the separators 106*a*, 106*b*. In other embodiments, the separators 106*a*, 106*b* may allow three or more clothing hangers 104 to fit therebetween.

Figure 2:
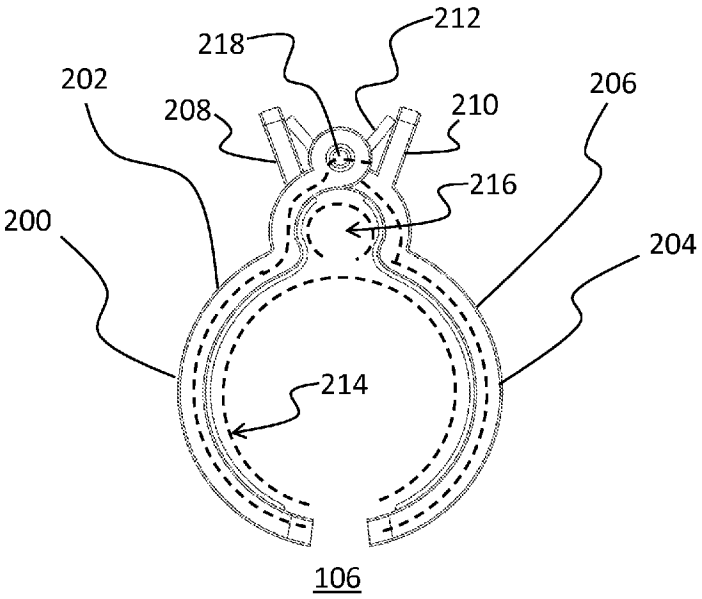
FIG. 2 is front elevational view of one of the plurality of separators of FIG. 1.

FIG. 2 depicts one embodiment of the separator 106 in accordance with the present invention. The separator 106 is shown having a first member 200 defining a first half 202 of the separator 106 and a second member 204 defining an opposing second half 206 of the separator 106. More specifically, the first member includes a first ear 208 and the second member 204 includes a second ear 210. In use, movement of the first ear 208 relative to the second ear 210 results in a corresponding movement of the first member 200 relative to the second member 204. The movement of the first ear 208 and the second ear 210 allows the separator 106 to removably couple to the clothing rod 102.

Figure 3:
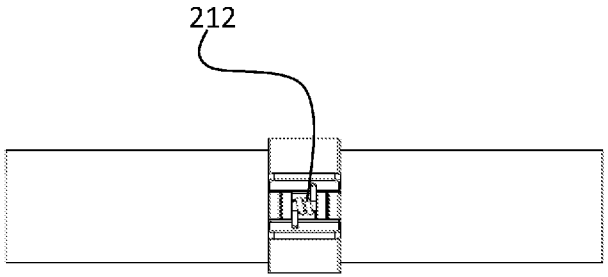
FIG. 3 is an elevational downward-looking view of one of the plurality of separators of FIG. 1 showing a spring loaded hinge attaching a first member to a second member in accordance with an embodiment of the present invention.

With reference to FIG. 2, in conjunction with FIG. 3, in order for the first member 200 and the second member 204 to move relative to each other, the first member 200 is hingedly coupled to the second member 204 at a pivot point 218. In one embodiment, the first member 200 may be hingedly coupled to the second member 204 by a spring loaded hinge 212 positioned at the location of the pivot point 218. FIG. 3 illustrates a top plan view of the spring loaded hinge 212. The spring loaded hinge 212 moves the first member 200 relative to the second member 204 at the pivot point 218 in order to removably couple the separator 106 to the clothing rod 102. In another embodiment, as illustrated in FIG. 12, the first member 200 may be hingedly coupled to the second member 204 by a spiral hinge 220. In other embodiments, the first member 200 may be hingedly coupled to the second member 204 by another connection mechanism.

Referring again to FIG. 2, the first member 200 and the second member 204 define a first inner-surface circumference 214 and a second inner-surface circumference 216 located adjacent the first inner-surface circumference 214. The first inner-surface circumference 214 is larger than the second inner-surface circumference 216. In one embodiment, the first inner-surface circumference 214 may be of a distance that is at least three times a distance of the second inner-surface circumference. In another embodiment, the distance of the first inner-surface circumference may be of a distance that is at least two times the distance of the second-inner surface circumference. Advantageously, the first inner-surface circumference 214 and the second inner-surface circumference 216 are sized and shaped to mate with standard clothing rods, which are currently offered in a limited variety of sizes, shapes and diameters.

Figure 4:
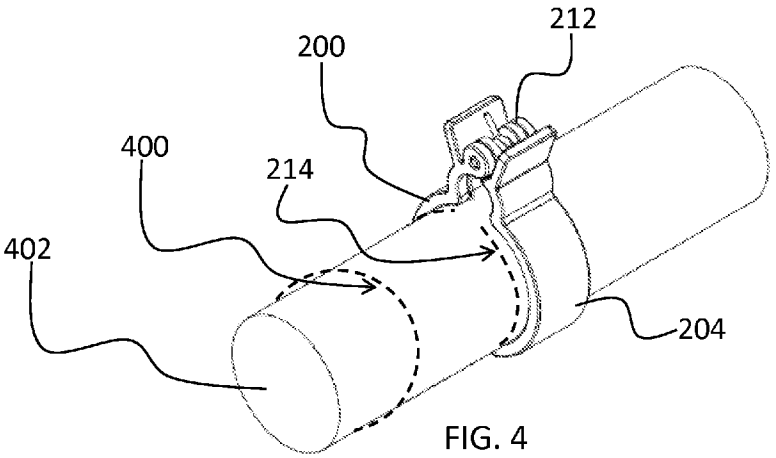
FIG. 4 is a perspective left front fragmentary view of an inner-surface of one of the plurality of separators of FIG. 1 removably coupled to an outer diameter of the standard clothing rod of FIG. 1.
Figure 5:
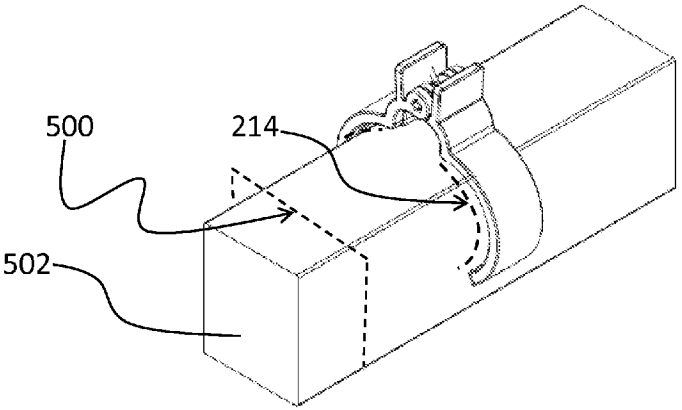
FIG. 5 is a perspective left front fragmentary view of an inner-surface of one of the plurality of separators of FIG. 1 removably coupled to an outer diameter of a square shaped clothing rod in accordance with an embodiment of the present invention.

Now referring to FIG. 4, the first inner-surface circumference 214 is shaped and sized to mate with an outer diameter 400 of a standard clothing rod 402. The outer diameter 400 of the standard clothing rod 402 is of a circular shape. In other embodiments, the first inner-surface circumference 214 may be sized and shaped to mate with an oval shaped clothing rod. In one embodiment, the first inner-surface circumference 214 is approximately 1.25 to 2.0 inches in width and is sized and shaped to mate with the outer diameter 400 that is approximately 1.25 to 2.0 inches in width. In other embodiments, the first inner-surface circumference 214 may be sized and shaped to mate with the outer diameter 400 outside of this range. With reference now to FIG. 5, the first inner-surface circumference 214 is shown mated with an outer diameter 500 of a rectangular clothing rod 502. In one embodiment, the outer diameter 500 may be approximately 1.25 to 2.0 inches in width. In other embodiments, the outer diameter 500 may vary outside of this range.

Figure 6:
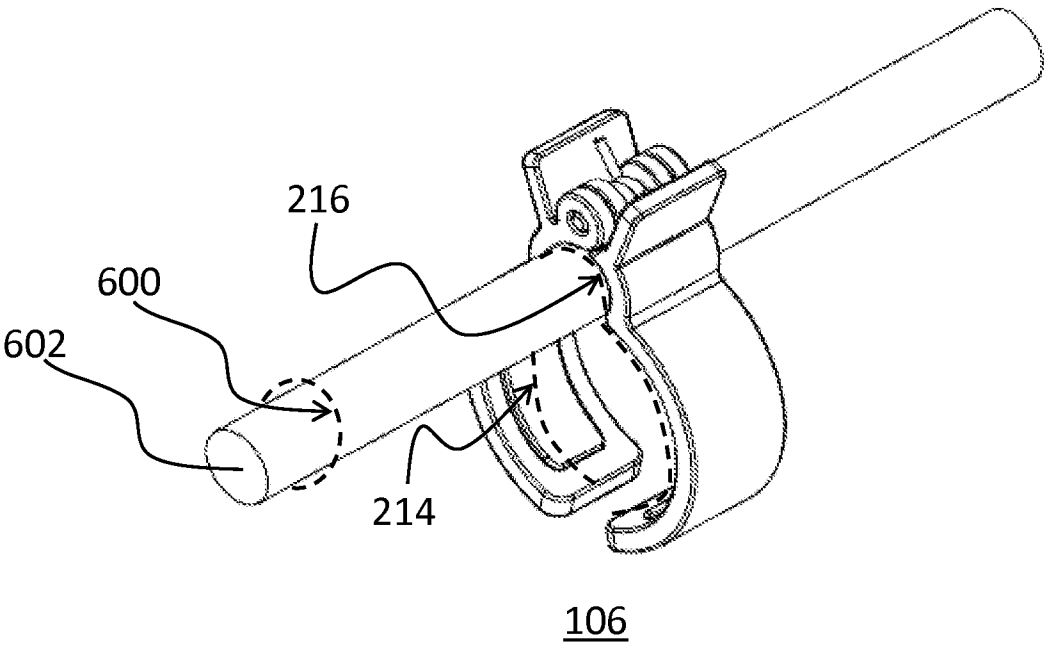
FIG. 6 is a perspective left front fragmentary view of an inner-surface of one of the plurality of separators of FIG. 1 removably coupled to a smaller-diameter clothing rod in accordance with an embodiment of the present invention.

Now referring to FIG. 6, the second inner-surface circumference 216 is shaped and sized to mate with an outer diameter 600 of a narrower-sized clothing rod 602. One example of such a narrower-sized clothing rod 602 is the FASTTRACK series manufactured by RUBBERMAID. Advantageously, the second inner-surface circumference 216 is smaller than the first inner-surface circumference 214 so that a user can utilize the separator 106 with the clothing rods of various sizes and shapes. In one exemplary embodiment, the clothing rod 602 may be attached to wire shelving used to store items normally found in a closet, e.g., handbags, shoes, and the like, thereon. In one embodiment, second inner-surface circumference 216 is approximately 0.5 to 1.0 inches in width and is sized and shaped to mate with the outer diameter 600 that is approximately 0.5 to 1.0 inches in width. In other embodiments, second inner-surface circumference 216 and the outer diameter 600 may vary outside of this range.

Referring now to FIG. 7, one embodiment of the present invention is shown with the separator 106 having a frictional coating 700 on the first inner-surface circumference 214 of the first member 200 and the second member 204. The frictional coating 700 is an anti-slip material that secures the separator 106 in a stationary position on the clothing rod 102 to prevent the separator 106 from sliding. The frictional coating 700 can be any friction-inducing material. The frictional coating 700 may be applied to at least one of the inner-surface circumferences 214, 216. In one embodiment, the frictional coating 700 is made of rubber. In other embodiments, the frictional coating 700 may be made of tape or another similar frictional coating with a coefficient of friction generally high enough to prevent the separator 106 from sliding laterally along the clothing rod 102, 602. Advantageously, the frictional coating 700 can easily be removed and replaced when necessary following normal wear and tear. In embodiments where the members 200, 204, are made of rubber or other material having a high enough coefficient of friction to prevent the separator 106 from sliding laterally along the clothing rod 102, 602, the frictional coating 700 may not be necessary.

Now referring to FIG. 8, a side view of the separator 106 is shown with a width 800 and a height 802. In one embodiment, the width 800 may be approximately 0.25 to 1.0 inch. In another embodiment, the width 800 may be 1.0 to 2.0 inches. The width 800 is designed to vary so that a user is provided with the option of maintaining a wider space between clothing hangers 104 holding bulky items, such as winter coats. An added objective of the present invention is to provide adequate spacing between garments having zippers, sequins, beads, and other decorations to reduce the risk of one garment snagging another garment. In one embodiment, the height 802 may be approximately 1.0 to 3.0 inches. In another embodiment, the height 802 may vary outside of this range.

FIGS. 9 and 10 provide a bottom view of the separator 106 substantially surrounding the outer diameter of a clothing rod 402 and 602, respectively. "Substantially surrounding" is defined herein as at least mostly, but not necessarily completely, surrounding the clothing rod. More specifically, FIG. 9 depicts the first member 200 and the second member 204 substantially surrounding the outer diameter 400 of the standard clothing rod 402. In this arrangement, the distal ends of the members 200 and 204 do not touch each other. FIG. 10 depicts the first member 200 and the second member 204 substantially surrounding the outer diameter 600 of the clothing rod 602. In this arrangement, the distal ends of the members 200 and 204 do not touch each other. The user is provided with the ability to quickly and selectively attach and detach the separator 106 from the clothing rod without having to remove the clothing hangers 104 (FIG. 1) to slide the separator 106 off of the clothing rod, as is the case with other known garment separators.

Referring now primarily to FIG. 11, in conjunction with FIGS. 1 and 2, there is provided a method of separating garments. The process of FIG. 11 begins at step 1100 and moves directly to step 1102, where a clothing rod, such as the clothing rod 102 of FIG. 1, and an array of clothing hangers 104 are provided. It is envisioned that clothing hangers 104 are hanging from the clothing rod 102. In one embodiment, the clothing rod 102 may be located in a home closet. In another embodiment, the clothing rod 102 may be attached to a clothing rack in a retail store. In yet another embodiment, the clothing rod 102 may be attached to a freestanding clothing rack.

In step 1104, an array of separators 106*a-n*, such as the first separator 106*a* and the second separator 106*b* of FIG. 1, are provided. In step 1106, the first separator 106*a* is removably coupled to the first side 110 of the clothing hanger 104*a* hanging from the clothing rod 102. In order to removably couple the first separator 106*a* to the first side 110, the first member 200 includes the first ear 208 mechanically coupled to the first member 200 and the second ear 210 mechanically coupled to the second member 204. The spring loaded hinge 212 moves the first ear 208 relative to the second ear 210, which results in a corresponding movement of the first member 200 relative to the second member 204. The movement of the first member 200 and the second member 204 allows the first inner-surface circumference 214 and the second inner-surface circumference 216 to mate with clothing rods of various shapes and sizes.

With reference to FIG. 11, in conjunction with FIGS. 4, 5 and 6, in one embodiment, the first inner-surface circumference 214 is shaped and sized to mate with an outer diameter 400 of a standard clothing rod 402 and the second inner-surface circumference 216 is shaped and sized to mate with a smaller outer diameter 600 of a narrower-sized clothing rod 602. Advantageously, a user is given the option of moving the separators 106*a-n* between clothing rods having different sized outer diameters of various shapes, such as the clothing rod 402 and the narrower-sized clothing rod 602. In one embodiment, the first inner-surface circumference 214 is approximately 1.25 to 2.0 inches in width and is sized and shaped to mate with the outer diameter 400 that is approximately 1.25 to 2.0 inches in width. In this embodiment, the second inner-surface circumference 216 is approximately 0.5 to 1.0 inch in width and is sized and shaped to mate with the outer diameter 600 that is approximately 0.5 to 1.0 inch in width. In other embodiments, the first inner-surface circumference 214 and the second inner-surface circumference may vary outside of this range. In one embodiment, the first inner-surface circumference 214 is sized and shaped to mate with a circular clothing rod 402. In other embodiments, the first inner-surface circumference 214 may be sized and shaped to mate with an oval shaped clothing rod. In yet another embodiment, the first inner-surface circumference 214 may be sized and shaped to mate with a rectangular shaped clothing rod, such as the rectangular shaped clothing rod 502 of FIG. 5.

In step 1108, the second separator 106*b* is removably coupled to an opposing second side 114 of the clothing hanger 104*a*. Advantageously, to provide even spacing when there are an array of clothing hangers 104 hanging from the clothing rod 102, the first separator 106*a* and the second separator 106*b* are distanced to only allow a single clothing hanger 104 to fit between the first separator 106*a* and the second separator 106*b*. In one embodiment, each of the separators 106*a-n* may be of an equal width to maintain even and consistent spacing between all of the clothing hangers 104 hanging from the clothing rod 102. In another embodiment, the array of separators 106*a-n* may be provided in a kit, which includes the array of separators 106*a-n* divided into groups, each group consisting of one of a variety of widths e.g., 0.5 inch, 1.0 inch, 1.5 inches, etc. In use, the variety of widths provide a user with the option of maintaining even spacing between different categories of garments hanging from the clothing hangers 104, to reduce the risk of garments snagging one another. For example, in one embodiment, the user may place a 0.5 inch separator 106 between clothing hangers 104 holding tops, a 1.0 inch separator 106 between clothing hangers 104 holding pants so that the pants' zipper does not snag an adjacent pants' zipper, a 1.5 inch separator 106 between clothing hangers 104 holding bulky coats that may have protruding zippers or buttons, and any other combination chosen by the user.

In another embodiment, the kit may include the array of separators 106*a-n* that are divided into groups based on a variety of colors, e.g., red, blue, white, tan, etc. In one embodiment, the user may match the color of the separator 106 to the color of the garment hanging from the single clothing hanger 104, to separate the garments into different color categories for an aesthetically pleasing look. In another embodiment, the user may organize the separators 106*a-n* into colors based on the color of the clothing hanger 104, in order to match the clothing hanger 104 to the color of the separator 106 for a streamlined look. In another embodiment, the user may organize the separators 106*a-n* into colors based on the type of garment hanging from the clothing hanger 104, e.g., red separators for skirts, blue separators for tops, white separators for pants, etc. In another embodiment, the user may organize the garments and separators 106*a-n* into colors based on the season, e.g., red separators for fall garments, blue separators for spring garments, white separators for summer garments, etc. In another embodiment, the kit may include the array of separators 106*a-n* having the varying widths and the variety of colors. In a further embodiment, the separators 106*a-n* may be manufactured in a variety of patterns, e.g., animal print, floral, polka dots, stripes, etc. In this embodiment, the user is given the option of matching the pattern of the separators 106*a-n* to the pattern of the clothing hangers 104, for a matching and streamlined look.

In one embodiment, the first separator 106*a* and the second separator 106*b* may include a frictional coating. The frictional coating can be any friction-inducing material. The frictional coating secures the separators 106*a*, 106*b* in a stationary position and prevents the separators 106*a*, 106*b* from sliding on the clothing rod 102. In another embodiment, the members 200, 204 may be made of rubber or other material having a high enough coefficient of friction to prevent the separator 106*a*, 106*b* from sliding laterally along the clothing rod 102 such that the frictional coating may not be necessary. The process ends at step 1110.

A garment separator assembly and method of separating garments has been disclosed that features a separator with a first member and a second member defining a first inner-surface circumference and a second inner-surface circumference, that are sized and shaped to mate with clothing rods of various shapes and sizes. Other features of the invention have been disclosed that provide at least two separators having a single clothing hanger between the at least two separators, for maintaining even space between clothing hangers, but are not intended to be limited to the particular details disclosed herein.

What is claimed is:

1. A garment separator assembly comprising:

at least two separators, each separator including:

a first member defining a first half of the separator; and a second member defining an opposing second half of the separator, the second member being hingedly coupled to the first member and, together with the first member, defining a first inner-surface circumference and a second inner-surface circumference adjacent and non-coaxial with the first inner-surface circumference, the first inner-surface circumference being larger than the second inner-surface circumference;

the first inner-surface circumference shaped and sized to mate with a first outer diameter of a standard clothing rod; and the second inner-surface circumference shaped and sized to mate with a second outer diameter of a clothing rod, wherein the second outer diameter is smaller than the first outer diameter of the standard clothing rod.

2. The garment separator assembly according to claim 1, further comprising:

a spring loaded hinge attaching the first member to the second member.

3. The garment separator assembly according to claim 2, further comprising:

a first ear mechanically coupled to the first member and a second ear mechanically coupled to the second member, wherein movement of the first ear relative to the second ear results in a corresponding movement of the first member relative to the second member.

4. The garment separator assembly according to claim 1, further comprising:

a frictional coating on at least one of the first inner-surface circumference and the second inner-surface circumference.

5. The garment separator assembly according to claim 1, further comprising:

a clothing rod; and a plurality of clothing hangers coupled to the clothing rod and each separated by a separator.

6. The garment separator assembly according to claim 5, wherein:

the separators are spaced a distance apart that allows only a single clothing hanger to fit there between.

7. In combination with a clothing closet having a horizontal clothing rod and a plurality of clothing hangers hanging from the horizontal clothing rod, the improvement comprising:

a first separator on a first side of one of the plurality of clothing hangers and a second separator on an opposing second side of the one of the plurality of clothing hangers, the first separator and the second separator distanced to only allow the one of the plurality of clothing hangers to fit there between and each separator including:

a first member defining a first half of the separator;

and a second member defining an opposing second half of the separator, the second member being hingedly coupled to the first member and, together with the first member, defining a first inner-surface circumference and a second inner-surface circumference adjacent and non-coaxial with the first inner-surface circumference, the first inner-surface circumference being larger than the second inner-surface circumference;

the first inner-surface circumference shaped and size to mate with an outer diameter of a standard clothing rod; and the second inner-surface circumference shaped and sized to mate with an outer diameter of a smaller-than-standard-size clothing rod, wherein the outer diameter of the smaller-than-standard-size clothing rod is smaller than the outer diameter of the standard clothing rod.

8. The improvement according to claim 7, wherein:

the outer diameter is at least one of a circular and rectangular shape.

9. The improvement according to claim 7, wherein:

the first member and the second member substantially surround the outer diameter of the standard clothing rod.

10. The improvement according to claim 7, further comprising:

a first ear mechanically coupled to the first member at a pivot point and a second ear mechanically coupled to the second member at the pivot point, wherein movement of the first ear relative to the second ear results in a corresponding movement of the first member relative to the second member.

11. The improvement according to claim 7, further comprising:

a frictional coating on at least one of the first inner-surface circumference and the second inner-surface circumference.

12. The improvement according to claim 7, wherein:

the first separator and the second separator are selectively detachable from the horizontal clothing rod.

13. A method of separating garments, comprising the steps of:

providing a horizontal clothing rod and a plurality of clothing hangers hanging from the horizontal clothing rod;

providing at least two separators, each separator including:

a first member defining a first half of the separator; and a second member defining an opposing second half of the separator, the second member being hingedly coupled to the first member and, together with the first member, defining a first inner-surface circumference and a second inner-surface circumference adjacent the first inner-surface circumference, the first inner-surface circumference being larger than the second inner-surface circumference, the first inner-surface circumference shaped and sized to mate with an outer diameter of a standard clothing rod and the second inner-surface circumference shaped and sized to mate with a smaller outer diameter of a narrower sized clothing rod;

removably coupling at least one of the at least two separators to a first side of one of the plurality of clothing hangers;

and removably coupling a second one of the at least two separators to an opposing second side of the one of the plurality of clothing hangers.

14. The method according to claim 13, wherein:

the at least two separators are distanced to only allow the one of the plurality of clothing hangers to fit there between.

15. The method according to claim 13, further comprising:

a spring loaded hinge attaching the first member and the second member.

16. The method according to claim 13, further comprising:

a frictional coating on at least one of the first inner-surface circumference and the second inner-surface circumference.

17. The method according to claim 13, further comprising:

a first ear mechanically coupled to the first member and a second ear mechanically coupled to the second member, wherein movement of the first ear relative to the second ear results in a corresponding movement of the first member relative to the second member.

* * * * *